US006042626A

United States Patent [19]

Schwab

[11] Patent Number: 6,042,626

[45] **Date of Patent: *Mar. 28, 2000**

[54] PHOSPHORYLATED AND/OR BORONATED DISPERSANTS AS THERMAL STABILITY ADDITIVES FOR DISTILLATE FUELS

[75] Inventor: Scott D. Schwab, Richmond, Va.

[73] Assignee: Ethyl Corporation, Richmond, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,027

[22] Filed: Aug. 1, 1997

[51] Int. Cl.[7] ..... C10L 1/30; C10L 1/26

[52] U.S. Cl. ..... 44/315; 44/317

[58] Field of Search ..... 44/315, 317

[56] References Cited

U.S. PATENT DOCUMENTS

| | | | |
|---|---|---|---|
| 3,254,025 | 5/1966 | LeSuer | 252/32.7 |
| 3,325,261 | 6/1967 | Knowles et al. | 44/315 |
| 3,697,574 | 10/1972 | Piasek et al. | 508/195 |
| 4,016,092 | 4/1977 | Andress | 44/317 |
| 4,032,304 | 6/1977 | Dorer, Jr. et al. | 44/398 |
| 4,092,127 | 5/1978 | Ryer et al. | 44/317 |
| 4,140,492 | 2/1979 | Feldman et al. | 44/317 |
| 4,184,851 | 1/1980 | Feldman | 44/317 |
| 4,522,629 | 6/1985 | Horodysky et al. | 44/315 |
| 4,855,074 | 8/1989 | Papay et al. | 252/51.5 A |
| 4,857,214 | 8/1989 | Papay et al. | 252/32.5 |
| 4,925,983 | 5/1990 | Steckel | 44/317 |
| 5,139,643 | 8/1992 | Roling et al. | 208/48 AA |
| 5,211,834 | 5/1993 | Forester | 208/48 |
| 5,241,003 | 8/1993 | Degonia et al. | 525/123 |
| 5,505,868 | 4/1996 | Ryan et al. | 252/49.8 |
| 5,789,356 | 8/1998 | Tiffany, III | 508/293 |

FOREIGN PATENT DOCUMENTS

| | | | |
|---|---|---|---|
| 0 476 196 A1 | 3/1992 | European Pat. Off. | 1/14 |
| 0 537 387 A1 | 4/1993 | European Pat. Off. | 133/52 |
| 678568A1 | 10/1995 | European Pat. Off. . | |
| WO 85/03504 | 8/1985 | WIPO | 51/567 |

OTHER PUBLICATIONS

"Development of Thermal Stability Additive Packages for JP–8", Anderson, S.D. et al., 5th International Conference on Stability and Handling of Liquid Fuels, Oct. 1994.

*Primary Examiner*—Ellen M. McAvoy
*Attorney, Agent, or Firm*—Dennis H. Rainear; Thomas Hamilton

[57] ABSTRACT

The present invention relates to phosphorylated and/or boronated dispersants useful as thermal stability additives in distillate fuels, such as jet or diesel fuel, and fuel compositions containing said dispersants.

20 Claims, No Drawings

PHOSPHORYLATED AND/OR BORONATED DISPERSANTS AS THERMAL STABILITY ADDITIVES FOR DISTILLATE FUELS

BACKGROUND OF THE INVENTION

1. Field of the Invention

The present invention relates to dispersants, which have been phosphorylated and/or boronated, useful as thermal stability additives in distillate fuels. Subjecting distillate fuels to thermal stress tends to result in significant deposit formation in the fuel and exhaust systems. It is highly desirable and an object of this invention to reduce the deposit formation in thermally stressed distillate fuels, such as jet fuel and diesel fuel. This goal is obtained by formulating distillate fuel compositions containing phosphorylated and/or boronated dispersants which are the reaction products of i) at least one phosphorus compound and/or a boron compound and ii) at least one ashless dispersant.

2. Background Discussion

Phosphorylated, boronated dispersants within the scope of the present invention are known and disclosed in U.S. Pat. No. 4,857,214 (Papay et al.) for use as antiwear additives for lubricants. The No. 4,857,214 patent does not disclose that these dispersants are useful in fuel compositions or suggest that these additives would be effective at reducing deposit formation in thermally stressed distillate fuels. Most particularly, the No. 4,857,214 patent does not relate to fuel compositions or teach the use of phosphorylated, boronated dispersants in distillate fuels.

U.S. Pat. No. 5,505,868 (Ryan et al.) discloses dispersants formed by reacting ashless dispersants, with at least one dibasic acylating agent, a phosphorus compound and a boron compound. The No. 5,505,868 patent further mentions that the dispersants can be used as detergents or deposit reducers in hydrocarbonaceous fuels.

In U.S. Pat. No. 5,139,643 (Roling et al.) phosphorus derivatives of polyalkenylsuccinimides as antifoulants in liquid hydrocarbonaceous mediums, such as crude oil, are disclosed. The reference does not teach the use of phosphorylated polyalkenylsuccinimides in distillate fuel compositions.

U.S. Pat. No. 4,855,074 (Papay et al.) discloses products formed from a long chain succinimide and a benzotriazole which are optionally boronated. These products are formed by reaction in the presence of an amine or an organic phosphorus compound. The use of these dispersants in fuels is mentioned.

European Patent No. 0,678,568 discloses methods and compositions for reducing fouling deposit formation in jet engines. The methods employ a derivative of (thio) phosphonic acid added to the turbine combustion fuel.

SUMMARY OF THE INVENTION

It is an object of this invention to provide a distillate fuel composition containing phosphorylated and/or boronated dispersants which are the reaction products of i) at least one phosphorus compound and/or a boron compound and ii) at least one ashless dispersant.

Further, it is an object of this invention to provide distillate fuel compositions which exhibit a significant improvement in the reduction of deposit formation in the fuel and exhaust systems.

DETAILED DESCRIPTION

Subjecting distillate fuels to thermal stress tends to result in significant deposit formation. The function of the dispersants of the present invention is to reduce deposit formation anywhere in the fuel and exhaust systems. In jet fuel compositions, for instance, this includes reducing deposit formation in the fuel nozzles and spray rings, and on surfaces such as the augmentor fuel manifolds, actuators and turbine vanes and blades. In other distillate fuel compositions, such as diesel fuel, the addition of the dispersants of the present invention serves to prevent injector deposits and to increase fuel stability.

The distillate fuel compositions of the present invention contain ashless dispersants which have been phosphorylated and/or boronated. These dispersants are preferably the reaction products of i) at least one phosphorus compound and/or a boron compound and ii) at least one ashless dispersant.

Suitable phosphorus compounds for forming the dispersants of the present invention include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include fill and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid; the trihydrocarbyl phosphine oxides; the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_6P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming products suitable for use as component b) in the practice of this invention. Also usable, though less preferred, are the inorganic phosphorus halide compounds such as $PCl_3$, $PBr_3$, $POCl_3$, $PSCl_3$, etc. The preferred phosphorus reagent is phosphorous acid, ($H_3PO_3$).

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof, esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)-O-P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable, although less preferred, are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

When using an organic phosphorus compound, it is preferable to use a water-hydrolyzable phosphorus compound, especially a water hydrolyzable dihydrocarbyl hydrogen phosphite, and water in the phosphorylation reaction so that the phosphorus compound is partially (or completely) hydrolyzed during the reaction.

Suitable boron compounds useful in forming the dispersants of the present invention include any boron compound or mixtures of boron compounds capable of introducing boron-containing species into the ashless dispersant. Any boron compound, organic or inorganic, capable of undergoing such reaction can be used. Accordingly use can be made of boron oxide, boron oxide hydrate, boron trifluoride, boron tribromide, boron trichloride, $HBF_4$ boron acids such as boronic acid (e.g., alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol, diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ethylene chlorohydrin, o-chlorophenol, m-nitrophenol, 6-bromo-octanol, m-nitrophenol, 6-bromo-octanol, m-nitrophenol, 6-bromo-octanol, and 7-keto-decanol. Lower alcohols, 1,2-glycols, and 1,3-glycols, i.e., those having less than about 8 carbon atoms are especially useful for preparing the boric acid esters for the purpose of this invention.

The ashless dispersants suitable for use in the present invention include those well known as lubricating oil additives. They include the hydrocarbyl-substituted succinamides and succinimides of polyethylene polyamines such as tetraethylene-pentamine which are more fully described for example in U.S. Pat. Nos. 3,172,892; 3,219,666 and 3,361,673 whose disclosures are incorporated herein by reference. Other examples of suitable ashless dispersants include (i) mixed ester/amides of hydrocarbyl-substituted succinic acid made using alkanols, amines, and/or aminoalkanols, (ii) hydrocarbyl-substituted succinic acid hydroxyesters containing at least one free hydroxyl group made using polyhydroxy alcohols such as are disclosed in U.S. Pat. No. 3,381,022 whose disclosure is incorporated herein by reference and (iii) the Mannich dispersants which are condensation products of hydrocarbyl-substituted phenols, formaldehyde and polyethylene polyamines such as are described, for example, in U.S. Pat. Nos. 3,368,972; 3,413,374; 3,539,633; 3,649,279; 3,798,247 and 3,803,039 whose disclosures are incorporated herein by reference. The hydrocarbyl substituent is usually a polyolefin and preferably a polyisobutylene group having a number average molecular weight of from about 500 to 5,000. The ashless dispersant is preferably a hydrocarbyl-substituted succinimide, a Mannich condensation product, or a mixture of a hydrocarbyl-substituted succinimide and a Mannich condensation product. When mixtures of ashless dispersants are used, each dispersant may independently be phosphorylated and/or boronated.

While additional reactants, such as benzotriazoles as taught in U.S. Pat. Nos. 4,857,214 and 4,855,074, and dibasic acylating agents as taught in U.S. Pat. No. 5,505,868 can be used in forming the dispersant of the present invention, the preferred dispersants do not contain benzotriazoles or additional dibasic acylating agents. In a preferred embodiment, the phosphorylated and/or boronated ashless dispersants of the present invention consist essentially of the reaction product of i) at least one phosphorus compound and/or a boron compound and ii) at least one ashless dispersant Optionally, additional sources of basic nitrogen can be included in the phosphorus and/or boron-ashless dispersant mixture so as to provide a molar amount (atomic proportion) of basic nitrogen up to that equal to the molar amount of basic nitrogen contributed by the ashless dispersant. Preferred auxiliary nitrogen compounds are long chain primary, secondary and tertiary alkyl amines containing from about 12 to 24 carbon atoms, including their hydroxyalkyl and aminoalkyl derivatives. The long chain alkyl group may optionally contain one or more ether groups. Examples of suitable compounds include but are not limited to oleyl amine, N-oleyltrimethylene diamine, N-tallow diethanolamine, N,N-dimethyl oleylamine and myristyloxapropyl amine.

In conducting the foregoing reactions, any temperature at which the desired reaction(s) occur at a satisfactory reaction rate can be used. Ordinarily, the phosphorylation reaction and/or the boronation reaction (whether conducted concurrently or separately) are conducted at temperatures in the range of 80 to 200° C., more preferably 100 to 150° C. However, departures from these ranges can be made whenever deemed necessary or desirable. These reactions may be conducted in the presence or absence of an ancillary diluent or liquid reaction medium. If the reaction is conducted in the absence of an ancillary solvent of this type, such is usually added to the reaction product on completion of the reaction. In this way the final product is in the form of a convenient solution compatible with the base fuel.

The proportions of the reactants will to some extent be dependent on the nature of the ashless dispersant being utilized, principally the content of basic nitrogen therein.

Thus optimal proportions may, in some cases, be best defined by performing a few pilot experiments.

As noted above, the dispersants of this invention are formed by subjecting an ashless dispersant to phosphorylation with at least one phosphorylation reagent, and/or boronation with at least one boronation reagent. If the ashless dispersants are both phosphorylated and boronated, these reactions will be conducted either concurrently or in sequence. It is, of course, not necessary that these reactions be conducted in the same plant or at periods of time proximate to each other. For example, in one embodiment of this invention, a phosphorylated ashless dispersant from one manufacturer need only be subjected to boronation with a boronating agent of the type described hereinabove in order to produce a phosphorylated-boronated ashless dispersant suitable for use in the present invention. Similarly one may procure a suitable boronated ashless dispersant from a given supplier and subject the same to phosphorylation in accordance with the procedures described herein to thereby produce a novel boronated-phosphorylated ashless dispersant suitable for use in the present invention. In short, the novel products of this invention can be produced in accordance with this invention by two or more distinct and separate parties, if desired.

Although it is preferred to use separate and distinct phosphorus compounds and boron compounds in effecting the phosphorylation and boronation reactions, it is possible to employ compounds which contain both phosphorus and boron in the molecule such as borophosphates, etc., in order to concurrently phosphorylate and boronate the ashless dispersant.

If present, the amount of phosphorus compound employed ranges from about 0.001 mole to 0.999 mole per mole of basic nitrogen and free hydroxyl in the reaction mixture up to one half of which may be contributed by an auxiliary nitrogen compound. When present, the amount of boron compound employed ranges from about 0.001 mole to about 1 mole per mole of basic nitrogen and/or hydroxyl in the mixture which is in excess of the molar amount of phosphorus compound.

The amount of added water, if any, is not particularly critical as it is removed by distillation at the end of the reaction. Amounts of water up to about one percent by weight of the mixture are preferred. When used, the amount of diluent generally ranges from about 10 to about 50 percent by weight of the mixture. When added, the amount of copper protectant generally ranges from about 0.5 to 5 percent by weight of the mixture.

Generally, the following amounts of ingredients in relative proportions by weight are used in the reaction:

| | |
|---|---|
| Dispersant | 0.2 to 10 parts |
| Phosphorus Acid | 0.005 to 2 parts |
| $H_2O$ | 0 to 2 parts |
| Diluent Oil or Solvent | 0 to 10 parts |
| Boric Acid | 0 to 2 parts |
| Auxiliary Nitrogen Compound | 0 to 5.0 parts |

Preferred amounts are:

| | |
|---|---|
| Dispersant | 1 to 5 parts |
| Phosphorus Acid | 0.01 to 0.5 part |
| Water | 0.01 to 1 part |
| Diluent | 0.5 to 3 parts |
| Boric Acid | 0 to 0.5 part |
| Auxiliary Nitrogen Compound | 0.001 to 2.0 parts |

The dispersants of the present invention are used in a fuel in any amount sufficient to reduce the formation of deposits in the fuel and exhaust systems of an engine, such as a compression ignition or jet engine. Preferably, the dispersant is used in an amount of from about 1 to about 1000 mg/liter of fuel, most preferably in the range of from about 30 to about 200 mg/liter of fuel, on an active ingredient basis, i.e., excluding diluent or solvent.

The preferred distillate fuels for use in the present invention are diesel fuels and jet fuels, more preferably, JP-8 jet fuels.

Other components which may be used with the dispersants of the present invention include ashless dispersants which are non-phosphorylated and non-boronated, antioxidants, metal deactivators, corrosion inhibitors, conductivity improvers (e.g., static dissipators), fuel system icing inhibitors, distillate fuel stabilizers, cetane improvers and demulsifiers.

The various additional components that can be included in the distillate fuel compositions of this invention are used in conventional amounts. Thus, the amounts of such optional components are not critical to the practice of this invention. The amounts used in any particular case are sufficient to provide the desired functional property to the fuel composition, and such amounts are well known to those skilled in the art.

HLPS Test

To evaluate the various dispersants and their effects on fuel compositions subjected to thermal stress, all samples were tested using a Hot Liquid Process Simulator (HLPS). For testing purposes all additives are evaluated in JP-8 jet fuel which is pumped for 250 minutes at 2.0 ml/min past a tube set at 320° C. The weight of deposit which accumulates on the tube is recorded, therefore lower deposit weight numbers are desirable in this test. The results are shown in Table 1. The dispersants used were polyisobutylene (PIB) based succinimides and Mannichs, as set forth in Table 2. All treat rates are based on active ingredients, i.e., excluding diluents or carrier fluids.

TABLE 1

HLPS Results

| Example # | Additive(s) | Additive Chemistry/Function | Treat Rate(s) (mg/l) | Deposit Weight (μg) |
|---|---|---|---|---|
| 1* | None (base fuel) | | — | 710 |
| 2* | S1 | Succinimide dispersant | 60 | 400 |
| 3 | S1-B1-P1 | S1 treated with boric and phosphorous acids | 44 | 200 |
| 4* | S2 | Succinimide dispersant | 81 | 400 |

TABLE 1-continued

HLPS Results

| Example # | Additive(s) | Additive Chemistry/Function | Treat Rate(s) (mg/l) | Deposit Weight (μg) |
|---|---|---|---|---|
| 5 | S2-P1 | S2 treated with phosphorous acid | 81 | 250 |
| 6* | S3 | Succinimide dispersant | 61 | 410 |
| 7 | S3-P1 | S3 treated with phosphorous acid | 61 | 300 |
| 8* | M1 | Mannich dispersant | 44 | 390 |
| 9 | M1-P1 | M1 treated with phosphorous acid | 45 | 200 |
| 10 | M1-P2 | M1 treated with phosphorous acid | 45 | 160 |
| 11 | M1-P3 | M1 treated with phosphorous acid | 45 | 170 |
| 12 | M1-B1 | M1 treated with boric acid | 45 | 250 |
| 13 | M1-B1-P1 | M1 treated with boric and phosphorous acids | 42 | 140 |
| 14 | M1-B1-P2 | M1 treated with boric and phosphorous acids | 42 | 100 |

*Comparative Examples

TABLE 2

| Dispersant | PIB molecular weight | Wt. % Nitrogen | Wt. % Phosphorus | Wt. % Boron |
|---|---|---|---|---|
| S1 | 900 | 3.31 | | |
| S1-B1-P1 | 900 | 3.28 | 1.71 | 0.79 |
| S2 | 950 | 3.71 | | |
| S2-P1 | 950 | 3.7 | 0.23 | |
| S3 | 1,300 | 2.95 | | |
| S3-P1 | 1,300 | 2.91 | 0.56 | |
| M1 | 1,500 | 2.89 | | |
| M1-B1 | 1,500 | 2.9 | | 0.48 |
| M1-P1 | 1,500 | 2.85 | 0.43 | |
| M1-P2 | 1,500 | 2.83 | 0.91 | |
| M1-P3 | 1,500 | 2.75 | 1.67 | |
| M1-P4 | 1,500 | 2.85 | 0.38 | |
| M1-B1-P1 | 1,500 | 2.85 | 0.46 | 0.48 |
| M1-B1-P2 | 1,500 | 2.83 | 1.05 | 0.48 |

The HLPS results, shown in Table 1, demonstrate that the phosphorylated and/or boronated dispersants of the present invention provide fuel compositions which exhibit significantly reduced deposit formation upon being subjected to thermal stress as compared to fuel compositions containing dispersants outside the scope of the present invention as is evidenced by the lower deposit weights obtained in fuel compositions of the present invention.

L-10 Test

The effectiveness of the dispersants of the present invention in improving injector cleanliness in diesel engines was also tested. The tests were run in a multi-cylinder diesel engine. The engine was operated on a typical commercial diesel fuel as a base fuel and the injector deposits were measured. The engine was then operated on a fuel containing the above base fuels with various dispersants. The test employed was a Cummins L-10 Test Cummins Corp. is an engine manufacturer located in Columbus, Ind. This test is designed to provide a test cycle capable of producing diesel injector deposits. The injector deposit test employs two Cummins L-10 engines connected in series front-to-rear with a driveshaft. While one engine is powering (approximately 55 to 65 horsepower), the other engine is closed throttle motoring.

The engines run for 125 hours. Coolant in/out temperatures and fuel temperatures are controlled to obtain repeatable results. The engine fuel system is then flushed to remove residual additive and the injectors with their respective plungers are removed. Without removing the plunger from the injectors, the injectors are flowed on a flow stand to determine percent Flow Rate Loss. The plungers are then carefully removed, so as not to disturb the deposits, from the injector bodies. Then the plunger minor diameter deposits are rated by the CRC (Coordinated Research Council, Atlanta, Ga.) rating method Manual #18. A higher rating indicates more deposits. By the CRC rating system, 0 represents new and 100 represents extremely dirty.

The fuels, additives and test results in terms of average Flow Rate Loss and average CRC Rating employing the Cummins L-10 Test are presented in Table 3. Treat rates are based on active ingredients in pounds per thousand barrels of base fuel. The description of the additives are set forth above in Table 2.

TABLE 3

Cummins L-10 Test Results

| Example # | Additive | Treat Rate (lb/1000 bbl) | Ave. Injector Rating | Ave. Injector Flow Loss |
|---|---|---|---|---|
| 15* | None (base fuel) | — | 27.9 | 3.1 |
| 16* | S2 | 32.3 | 10.2 | 2 |
| 17 | S2-P1 | 32.4 | 8.4 | 2.1 |
| 18 | M1-P4 | 17.8 | 6.1 | 0.4 |

*Comparative Examples

It is clear from the results in Table 3 that engines operated on fuels containing the dispersants of the present invention exhibit reduced injector deposits, as evidenced by the lower numerical values for Average Injector Rating and Average Injector Flow Loss.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

I claim:

1. A fuel composition which comprises a distillate fuel and an ashless dispersant which has been phosphorylated and/or boronated, wherein the dispersant is a mixture of dispersants comprising a) the reaction product of i) at least one phosphorus compound and at least one boron compound and ii) at least one hydrocarbyl succinimide and b) the reaction product of i) at least one boron compound and ii) at least one Mannich condensation product of hydrocarbyl-substituted phenols, formaldehyde and polyamines, and wherein the dispersants have not been further reacted with an additional dibasic acylating agent.

2. The composition of claim 1 wherein the amount of phosphorus compound is from about 0.001 mole to 0.999 mole per mole of basic nitrogen and hydroxyl in the composition and the amount of boron compound is from about 0.001 mole to 1 mole per mole of basic nitrogen and hydroxyl in the mixture which is in excess of the molar amount of phosphorus compound.

3. The composition of claim 1 wherein the phosphorus compound is an inorganic phosphorus containing acid or anhydride, including partial sulfur analogs thereof.

4. The composition of claim 1 wherein the hydrocarbyl groups of the ashless dispersants are polyisobutenyl groups having a number average molecular weight of from about 500 to 5,000.

5. The fuel composition of claim 1 wherein the phosphorylated and/or boronated dispersants are present in an amount sufficient to reduce the formation of deposits on the fuel and exhaust systems of an engine operating on said fuel composition.

6. The fuel composition of claim 1 wherein the phosphorylated and/or boronated dispersants are present in an amount of from about 1 to about 1000 mg/liter of fuel.

7. The fuel composition of claim 1 wherein the phosphorylated and/or boronated dispersants are present in an amount of from about 30 to about 200 mg/liter of fuel.

8. The fuel composition of claim 1 wherein the distillate fuel is selected from diesel fuel or jet fuel.

9. The fuel composition of claim 8 wherein the jet fuel is JP-8 jet fuel.

10. The fuel composition of claim 1 wherein at least one of the reaction products are formed in the presence of a $C_{12}$ to $C_{24}$ alkyl amine so as to provide a molar amount of nitrogen up to that equal to the molar amount of basic nitrogen contributed by the ashless dispersant.

11. The fuel composition according to claim 1 further comprising additives selected from the group consisting of ashless dispersants which are non-phosphorylated and non-boronated, antioxidants, metal deactivators, corrosion inhibitors, conductivity improvers, fuel system icing inhibitors, distillate fuel stabilizers, cetane improvers and demulsifiers.

12. A method of reducing deposit formation in engines, wherein said deposit formations are a result of distillate fuel subjected to thermal stress, which comprises fueling said engine with and operating said engine on a fuel composition comprising a distillate fuel and a dispersant which has been phosphorylated and/or boronated, wherein the dispersant is a mixture of dispersants comprising a) the reaction product of i) at least one phosphorus compound and at least one boron compound and ii) at least one hydrocarbyl succinimide and b) the reaction product of i) at least one boron compound and ii) at least one Mannich condensation product of hydrocarbyl-substituted phenols, formaldehyde and polyamines, and wherein the dispersants have not been further reacted with an additional dibasic acylating agent.

13. The method of claim 12 wherein the phosphorus compound is an inorganic phosphorus containing acid or anhydride, including partial sulfur analogs thereof.

14. A method of reducing deposit formation in engines according to claim 12 wherein the hydrocarbyl groups of the ashless dispersants are polyisobutenyl groups having a number average molecular weight of from about 500 to 5,000.

15. A method of reducing deposit formation in engines according to claim 12 wherein the phosphorylated and/or boronated dispersants are present in an amount of from about 1 to about 1000 mg/liter of fuel.

16. A method of reducing deposit formation in engines according to claim 12 wherein the phosphorylated and/or boronated dispersants are present in an amount of from about 30 to about 200 mg/liter of fuel.

17. A method of reducing deposit formation in engines according to claim 12 wherein the distillate fuel is selected from diesel fuel or jet fuel.

18. A method of reducing deposit formation in engines according to claim 7 wherein the jet fuel is JP-8 jet fuel.

19. A method of reducing deposit formation in engines according to claim 12 wherein said fuel composition further comprising additives selected from the group consisting of ashless dispersants which are non-phosphorylated and non-boronated, antioxidants, metal deactivators, corrosion inhibitors, conductivity improvers, fuel system icing inhibitors, distillate fuel stabilizers, cetane improvers and demulsifiers.

20. A fuel composition produced by adding to a distillate fuel a mixture of a) the reaction product of i) at least one phosphorus compound and at least one boron compound and ii) at least one hydrocarbyl succinimide and b) the reaction product of i) at least one boron compound and ii) at least one Mannich condensation product of hydrocarbyl-substituted phenols, formaldehyde and polyamines, and wherein a) and b) have not been further reacted with an additional dibasic acylating agent.

* * * * *